US006218777B1

(12) United States Patent
Jones et al.

(10) Patent No.: US 6,218,777 B1
(45) Date of Patent: Apr. 17, 2001

(54) FIELD EMISSION DISPLAY SPACER WITH GUARD ELECTRODE

(75) Inventors: Gary W. Jones; Webster E. Howard, both of Lagrangeville, NY (US)

(73) Assignee: eMagin Corporation, Hopewell Junction, NY (US)

( * ) Notice: Subject to any disclaimer, the term of this patent is extended or adjusted under 35 U.S.C. 154(b) by 0 days.

(21) Appl. No.: 09/073,344

(22) Filed: May 6, 1998

Related U.S. Application Data

(60) Provisional application No. 60/052,345, filed on Jul. 11, 1997.

(51) Int. Cl.[7] ..... H01J 1/62

(52) U.S. Cl. ..... 313/495; 313/332; 313/586

(58) Field of Search ..... 313/51, 318.12, 313/332, 318.01, 495, 586, 496, 497; 156/89.16

(56) References Cited

U.S. PATENT DOCUMENTS 3,962,597 * 6/1976 Clark et al. ..... 313/586
5,448,133 9/1995 Ise .
5,675,212 * 10/1997 Schmid et al. ..... 313/422
5,726,529 * 3/1998 Dean et al. ..... 313/495
5,916,396 * 6/1999 Schmid et al. ..... 313/495
5,936,343 * 8/1999 Fushimi et al. ..... 313/495

* cited by examiner

*Primary Examiner*—Nimeshkumar D. Patel
*Assistant Examiner*—Karabi Guharay
(74) *Attorney, Agent, or Firm*—David R. Yohannan; Collier Shannon Scott, PLLC

(57) ABSTRACT

A structure to reduce the likelihood of flashover in a parallel plate electron beam array is disclosed. The structure may comprise a spacer structure between the parallel plates along the outer perimeter of the plates. The spacer structure may include a conductive member. The conductive member may shunt anode to cathode flashovers to a sink outside of the array before they reach the cathode. The conductive member may be provided by a conductive frit made of a metal/glass mixture, a metal foil, or a metal coating that extends through or next to the spacer structure.

18 Claims, 1 Drawing Sheet

FIELD EMISSION DISPLAY SPACER WITH GUARD ELECTRODE

CROSS-REFERENCE TO RELATED PATENT APPLICATION

This application relates to and claims priority on provisional application serial No. 60/052,345 filed Jul. 11, 1997 and entitled "Field Emission Display Spacer With Guard Electrode".

FIELD OF THE INVENTION

The present invention relates to insulative spacers provided between parallel plates between which there is an electric potential. The insulative spacers of the invention may reduce the likelihood of surface electron flashover between the parallel plates.

BACKGROUND OF THE INVENTION

Parallel plate type electron beam arrays are known. Presently, such arrays are being provided in the form of microminiature field emitters, which are known in the microelectronics art. These microminiature field emitters are finding widespread use as electron sources in microelectronic devices. For example, field emitters may be used as electron sources in flat panel displays for use in aviation, automobiles, workstations, laptops, head wearable displays, heads up displays, outdoor signage, or practically any application for a screen which conveys information through light emission. Field emitters, as well as other types of electron beam arrays, may also be used in non-display applications such as power supplies, printers, and X-ray sensors.

Referring to FIG. 1, the cross-section of a parallel plate type electron beam emission device 10 is shown. The device includes a bottom plate 100, a spacer structure 200, and a top plate 300. The bottom plate 100 may comprise a substrate 110 and a conductive element 120. The bottom plate 100 may include additional elements in the interior of the device 10 including conductive gates, which are useful for emitting electrons in the direction of the top plate 300. The top plate 300 may comprise a substrate 310 and a conductive element 320. The top and bottom plates may be connected along their respective outer edge regions with the spacer structure 200. The spacer structure 200 may itself comprise an insulator frame or ring 210 bonded to the top and bottom plates with an upper glass frit 220 and a lower glass frit 230, respectively.

In order to achieve a beam of electrons, from the bottom plate 100 to the top plate 300, of a predetermined velocity, the upper conductive element 320 may be maintained at a high positive voltage relative to the source of electrons located on the bottom plate 100. Thus the upper conductive element 320 may also be referred to as an anode. If the device 10 is a display, the anode 320 may be implemented by a thin transparent conductive layer.

In order to operate the device 10, the space between the bottom plate 100 and the top plate 300 should be evacuated. Typically, this space may be of the order of 0.5 to 5 millimeters. To maintain the vacuum between the top and bottom plates, they are sealed to one another along their respective edges by the spacer structure 200. After being sealed, the space between the two plates, 100 and 300, may be evacuated of air or gas and sealed off from the outside atmosphere.

It is imperative to the operation of the device 10 to have as near to a perfect vacuum in the device as possible. The reason being that gas molecules within the device may become ionized as a result of being bombarded by the electrons in the device. If the gas pressure is high enough, there will be a growth in the ionization leading to a gas-discharge (breakdown flashover) between the anode 320 and the elements of the bottom plate 100. In devices in which the potential between the anode 320 and the bottom plate 100 is in the range of thousands of volts, such flashover may be catastrophic to the device 10. The flashover problem is particularly noticeable during the burn-in of new displays. Burn-in is carried out by operating a display at anode voltages well above those that would be experienced by the display during normal operation. It is at this time that displays are particularly susceptible to flashover.

The susceptibility of a display to flashover may be related to the density of gas in the region of the display where the flashover occurs. The density of gas molecules close to the display wall tends to be high on a short time scale. If the product (p)(d) of the local gas pressure (p) in the vicinity of the walls and the distance (d) between the anode and the gate is sufficient for a Paschen breakdown, then a cumulative ionization leading to a gas discharge (flashover) will occur between the anode and the gate. The flashover between the anode and the gate can trigger a flashover between that gate and corresponding emitters. For this reason most flashovers take place close to the sidewalls in a field emission display.

Prior to the present invention, adequate flashover control at high voltages (e.g., $\geqq$6KV) has been difficult. The primary method of combating flashover has been to reduce the operating potential between the anode 320 and the elements of the bottom plate 100. By decreasing the potential to levels of only a few hundred volts, the occurrence of flashover may be reduced, although it is far from eliminated.

Ise, U.S. Pat. No. 5,448,133 (issued Sep. 5, 1995) for a Flat Panel Field Emission Display Device with a Reflective Layer, touts the advantages of reducing the potential between the anode and cathode in a Field Emitter Display (FED). Ise states that a reduction of the operating voltage of a FED will reduce power consumption, which reduces battery size, and enables portability. Ise states that presently the low end threshold for anode to cathode potential is about 400 volts. Ise reports operation of his FED at as low as 100 volts of cathode to anode potential.

Reduction of the bottom plate to anode potential, however, as suggested by Ise, may reduce FED lifespan. Lifespan may be reduced because the luminous efficiency of the FED phosphors depends on the coulomb charge per unit volume applied to the phosphors over a period of time. The application of charge to the phosphors seems to dislocate activators from their sites in the phosphor host lattice, and thus decreases the activator excitation efficiency (by increasing the vacancy density). A phosphor layer of certain thickness, if operated by high voltage and low current, tends to have low values of coulombs per unit volume due to the increased penetration depth of the charge delivering electrons. On the other hand, if the same layer is operated with low voltage and high current (maintaining the same power) the coulombs per unit area increases because of the increased current, and the coulombs per unit volume increases even more due to the decreased penetration of the electrons (charge concentration at the surface of the layer). Increased coulomb density resulting from low voltage operation is more detrimental to the activators than high voltage operation over a given time span. Consequently the luminous efficiency decreases more rapidly for low voltage FED's. A decrease in light output may also occur in low voltage FED's due to the intervening passive thickness of the phosphor layer between the observer and the active surface layer.

The problems associated with sidewall induced flashovers, discussed above, may also arise in the interior portions of large sized screen FED's when low internal device pressure is maintained. Internal spacers are commonly used in FEDs to prevent the FED screen from bowing inward as a result of the pressure difference between atmosphere outside and the vacuum conditions of the FED interior. While the spacers beneficially keep the screen from bowing or breaking, the spacers also provide a surface linking the gate and anode which can facilitate flashovers. Trace residual gas or gas buildup on these surfaces can support plasma arcs.

Accordingly, there is a need for new methods and apparatus for reducing the occurrence of flashover, without reducing the level of anode voltages. There is also a need for methods and apparatus for reducing the magnitude of damage suffered from the occurrence of flashovers during the initial burn-in and operation of the device. There is a particular need for a device which does not readily support surface flashovers along the interior surfaces and/or internal spacers of the device. The present invention meets this need, and provides other benefits as well.

OBJECTS OF THE INVENTION

It is therefore an object of the present invention to provide methods and apparatus for reducing the occurrence of flashovers in parallel plate electron beam arrays.

It is another object of the present invention to provide methods and apparatus for reducing the amount of damage suffered from the occurrence of flashovers in parallel plate electron beam arrays.

It is a further object of the present invention to provide methods and apparatus for reducing the occurrence of flashovers which are supported by spacers in parallel plate electron beam arrays.

It is still yet another object of the present invention to provide methods and apparatus for increasing anode voltages in a parallel plate electron beam array without increasing the occurrence of flashovers in the array.

It is still a further object of the present invention to provide a spacer structure in an FED that includes a conductive member for shunting away a flashover discharge.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicants have developed an innovative, economical field emitter display having top and bottom plates separated by a spacer, a spacer structure comprising an insulative member adapted to separate said top and bottom plates; and a conductive member spaced from said top and bottom plates, said conductive member extending through said spacer structure.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

DETAILED DESCRIPTION OF THE PREFERRED EMBODIMENTS

Figure 1:
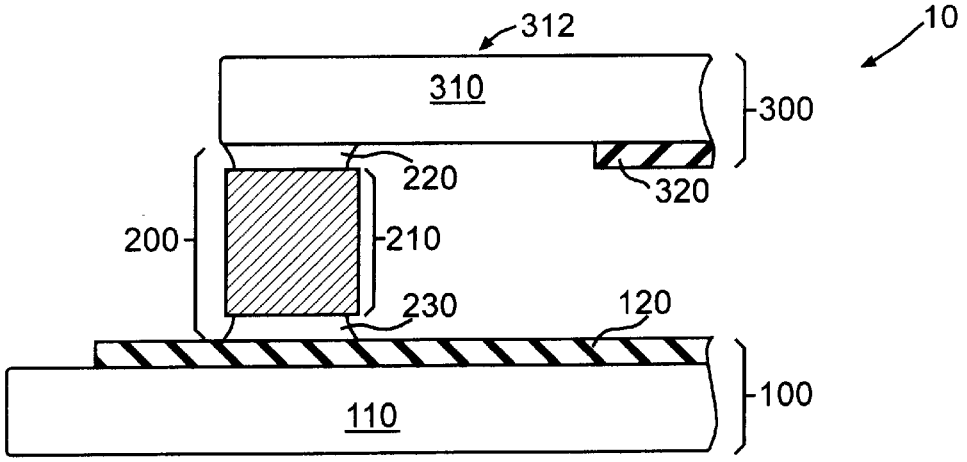
FIG. 1 is a cross-sectional view in elevation of the edge region of an electron beam array device.
Figure 2:
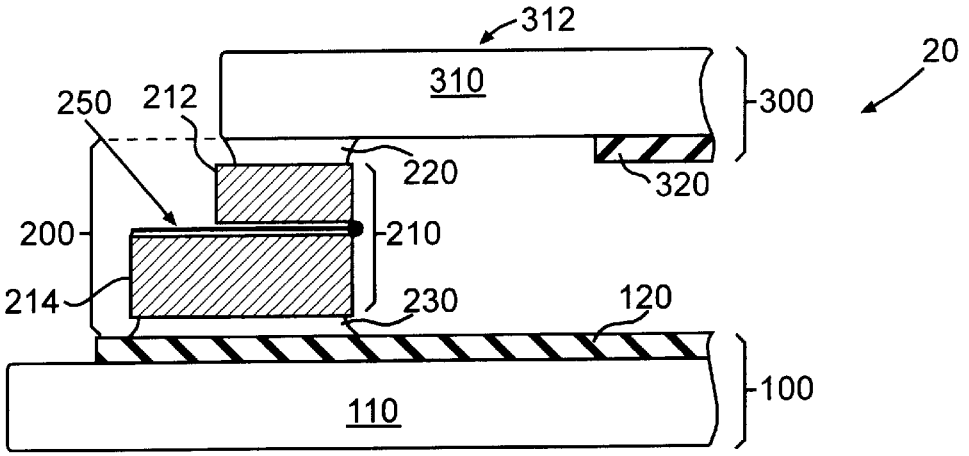
FIG. 2 is a cross-sectional view in elevation of the edge region of a first electron beam array embodiment of the invention.

Reference will now be made in detail to a preferred embodiment of the present invention, an example of which is illustrated in the accompanying drawings. A preferred embodiment of the present invention is shown in FIG. 2 as the edge portion of device 20. Device 20 may be any parallel plate electron beam array, including a field emitter display.

Device 20 comprises a bottom plate 100, a top plate 300, and a spacer structure 200. The spacer structure 200 includes an insulator frame or ring 210. Typically the insulator frame 210 may be made of glass, however, other insulative materials may be used. The insulator frame 210 may include plural insulative members 212 and 214 connected or fused together. For example, an upper insulative member 212 may be fused to a lower insulative member 214 using a glass frit therebetween to join the two insulative members.

A conductive member 250 may also be provided between the two insulative members 212 and 214. The conductive member 250 may be used to shunt flashover arcs, which otherwise might carry current from the high voltage anode 320 all the way to the conductive element 120. In this way, the current flows into conductive member 250 rather than into conductive element 120.

The insulative members 212 and 214 may have different cross-sectional dimensions as illustrated in FIG. 2. This permits contact to be made easily between the conductive member 250 and an electrical sink (not shown) outside of the device 20.

The fusing together of the insulative members 212 and 214 with the conductive member 250 therebetween may be carried out at a temperature of 350–450° C. This temperature should be low enough to avoid significant distortion to the top and bottom plates, 300 and 100 respectively. The frit glass used to fuse the insulative members together should be chosen such that it will wet the top and bottom plates, 300 and 100, the insulative members, 212 and 214, and the conductive member 250, without dissolving the conductive member. A lead oxide frit glass has been found to suffice when the top and bottom plates are glass.

The conductive member 250 may be made of any conductive material. In the embodiment illustrated by FIG. 2, the conductive member 250 may comprise a conductive frit made of a mixture of metallic particles and glass. Silver metallic particles have been used in particular.

Figure 3:
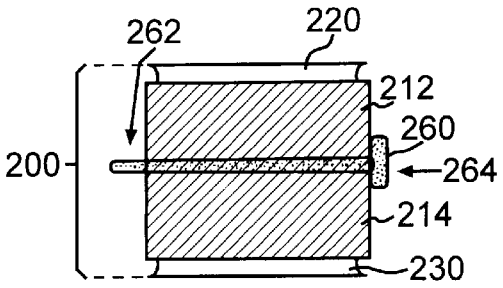
FIG. 3 is an alternative embodiment of the spacer structure shown in FIG. 2.

With regard to FIG. 3, the spacer structure 200 may be provided in an alternative embodiment by an insulator frame 210 having a conductive metal foil 260 extending therethrough. The metal foil may have a tab 262 that extends beyond the insulator frame 210. This tab may be especially useful for connecting the metal foil 260 to an electrical sink (not shown) when the insulative members 212 and 214 have the same cross-sectional widths. The metal foil may also be provided with an enlarged head portion 264. The head portion 264 may increase the amount of surface area of the foil exposed within the display to a discharge.

Figure 4:
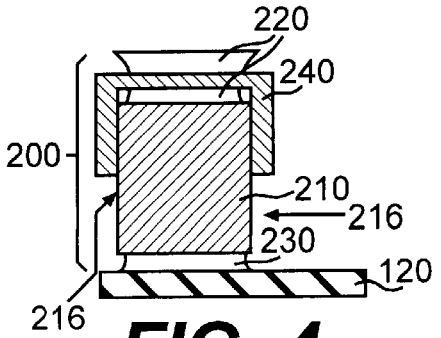
FIG. 4 is a second alternative embodiment of the spacer structure shown in FIG. 2.

With regard to FIG. 4, the spacer structure may be provided in another alternative embodiment by an insulator frame 210 with a metal coating 240 on an upper portion of the frame. The metal coating 240 is applied such that it covers portions of the sidewalls 216 of the insulator frame 210 without contacting the conductive element 120. The metal coating 240 may also include a tab (not shown) similar to that shown in FIG. 3 for connecting the coating to an external electrical sink.

It will be apparent to those skilled in the art that various modifications and variations can be made in the construction, configuration, and/or operation of the present invention without departing from the scope or spirit of the invention. For example, in the embodiments mentioned above, various changes may be made to the sealing materials used to connect the insulator frame with the top and bottom plates of the device. Further, changes may be made to the order in which the top and bottom plates are sealed to the insulator frame, and to which of the elements (the frame or the plates) the sealing means is first applied. Changes may also be made to the shape, size, and wall width of the insulator frame without departing from the scope or spirit of the invention. Further, it may be appropriate to make additional modifications or changes to the location of the conductive member relative to the insulator frame. Thus, it is intended that the present invention cover the modifications and variations of the invention provided they come within the scope of the appended claims and their equivalents.

We claim:

1. In a field emitter display having top and bottom plates separated by a spacer, a spacer structure comprising:

an insulative member adapted to separate said top and bottom plates; and a conductive member spaced and electrically insulated from said top and bottom plates, wherein said conductive member extends through said spacer structure.

2. The spacer structure of claim 1 wherein said conductive member comprises a conductive frit made of a glass and metal particle mixture.

3. The spacer structure of claim 1 wherein said conductive member comprises a metal foil.

4. The spacer structure of claim 3 wherein said conductive member comprises an enlarged head portion within the display.

5. The spacer structure of claim 3 wherein said conductive member comprises a tab on the exterior of the display extending beyond said insulative member.

6. The spacer structure of claim 1 wherein said conductive member comprises a metal coating on a portion of said insulative member.

7. The spacer structure of claim 6 wherein said insulative member has plural sidewalls and said metal coating is provided on a portion of one or more insulative member sidewalls.

8. The spacer structure of claim 1 wherein said conductive member extends through said insulative member.

9. The spacer structure of claim 1 wherein said spacer structure further comprises a frit glass structure connecting said insulative member to said top plate.

10. The spacer structure of claim 9 wherein said conductive member extends through said frit glass structure.

11. The spacer structure of claim 1 wherein said insulative member comprises first and second insulative frames connected together and having said conductive member extending between said insulative frames.

12. The spacer structure of claim 11 wherein said first insulative frame is wider than said second insulative frame in a dimension substantially parallel to the planar dimension of said top and bottom plates.

13. A field emitter display comprising top and bottom plates connected together with an insulative member, and a conductive member adapted to shunt an electrical discharge from an interior portion of the display to an exterior portion.

14. The display of claim 13 wherein said insulative member comprises first and second frames connected together with said conductive member extending therebetween.

15. The display of claim 14 wherein said first frame is wider than said second frame.

16. The display of claim 15 wherein said conductive member comprises a conductive frit made of a mixture metal particles and glass.

17. The display of claim 13 wherein said conductive member comprises a metal coating on said insulative member.

18. The display of claim 13 wherein said conductive member comprises a metal foil extending through said insulative member.

* * * * *